United States Patent [19]

Hanawalt

[11] 4,005,642

[45] Feb. 1, 1977

[54] CROSS-OVER PORT CONSTRUCTION FOR HYDRAULIC MOTORS

[75] Inventor: Larry D. Hanawalt, Mansfield, Ohio

[73] Assignee: Shafer Valve Company, Mansfield, Ohio

[22] Filed: Aug. 6, 1975

[21] Appl. No.: 602,381

[52] U.S. Cl. ..... 92/122

[51] Int. Cl.[2] ..... F01C 9/00

[58] Field of Search ..... 92/122; 91/376 A, 339, 91/340

[56] References Cited

UNITED STATES PATENTS

| | | | |
|---|---|---|---|
| 3,181,437 | 5/1965 | Rumsey et al. | 92/122 |
| 3,327,592 | 6/1967 | Wilkinson | 92/122 |
| 3,392,635 | 7/1968 | Sperl et al. | 92/122 |

*Primary Examiner*—Paul E. Maslousky
*Attorney, Agent, or Firm*—Hamilton, Renner & Kenner

[57] ABSTRACT

A rotary hydraulic motor valve operator having a rotor shaft with diametrically opposite vanes operating between diametrically opposite stops forming two pairs of fluid chambers, one chamber of each pair being connected through the top plate of the motor housing with a conduit which alternates as a supply or an exhaust conduit. Annular cross-over grooves at different levels in the top plate around the rotor shaft are connected one to the opposite chambers of each pair.

3 Claims, 5 Drawing Figures

CROSS-OVER PORT CONSTRUCTION FOR HYDRAULIC MOTORS

BACKGROUND OF THE INVENTION

The rotary hydraulic motor shown in prior U.S. Pat. No. 2,795,212 has cross-over ports through the rotor shaft connecting the opposite fluid chambers and a pressure or exhaust port extending through the side wall connected with one of each pair of opposite fluid chambers. The pressure and exhaust ports are connected with the bottoms of tanks containing oil, and gas pressure is applied to the top of one tank while the top of the other is connected to exhaust, as shown in prior U.S. Pat. No. 2,915,042. The rotor shaft is connected to the valve stem of a rotary valve in a pipeline, and fluid flow in one direction closes the valve while reversing the flow opens it.

The continuous oil system from one tank through the hydraulic motor to the other tank provides a non-compressible fluid which substantially eliminates cushioning of the rotor piston which would result in floating or overtravel when stopped. However, due to the high pressure of the gas applied to the oil tanks some gas bubbles are entrained in the oil.

The operation of drilling the cross-over ports in the rotor shaft was difficult and expensive, and in the hydraulic motor in prior U.S. Pat. No. 2,811,142, the cross-over ports comprised annular grooves around the rotor shaft in the top and bottom plates of the motor, one groove connecting opposite chambers of one pair and the other groove connecting opposite chambers of the other pair. As the rotor shaft is always disposed vertically the entrained gas bubbles rose to the top and accumulated in the upper cross-over groove, where they remained trapped despite reversing the flow through the motor because the pressure and exhaust ports were in the side wall of the motor cylinder. This accumulated gas usually contains acid and causes corrosion, as well as causing cushioning of the rotor.

SUMMARY OF THE INVENTION

It was first proposed that the pressure and exhaust ports be located in the top plate so that when flow is reversed bubbles entrapped in the upper cross-over groove would be exhausted to the oil tank on the exhaust side of the motor where they rise to the top of the oil level and thence go to the exhaust gas line. This construction allowed venting of the two opposite chambers connected by the upper cross-over groove when flow was reversed and allowed venting of that one of the other two chambers to which the exhaust port was connected. The second of the other two chambers was not vented because it was never connected to exhaust at the top of the chamber.

The present construction comprises a rotary hydraulic motor valve operator having two ports acting alternately as supply or exhaust ports in the top plate each connected to one of each pair of opposed fluid chambers, and annular cross-over grooves at different levels in the top plate around the rotor shaft and connected one to the opposed chambers of each pair.

It is an object of the present invention to provide an improved rotary hydraulic motor operator construction for a pipeline valve utilizing a closed oil system powered by gas pressure for operating the hydraulic motor, wherein entrained gas bubbles in the oil system are vented from all chambers of the motor when flow through the motor is reversed.

This and other objects are accomplished by the improvements comprising the present invention, a preferred embodiment of which is shown by way of example in the accompanying drawings and described in detail in the following specification. Various modifications and changes in details of construction are comprehended within the scope of the appended claims.

BRIEF DESCRIPTION OF THE DRAWINGS

Referring to FIG. 1, the prior art hydraulic operator system shown is applied to a valve 10 connecting two sections 11 and 12 of a pipeline conducting gas under pressure, the valve being a rotary type with its stem keyed to the rotor 14 of the rotary vane motor having a cylindrical housing 15.

Figure 1:
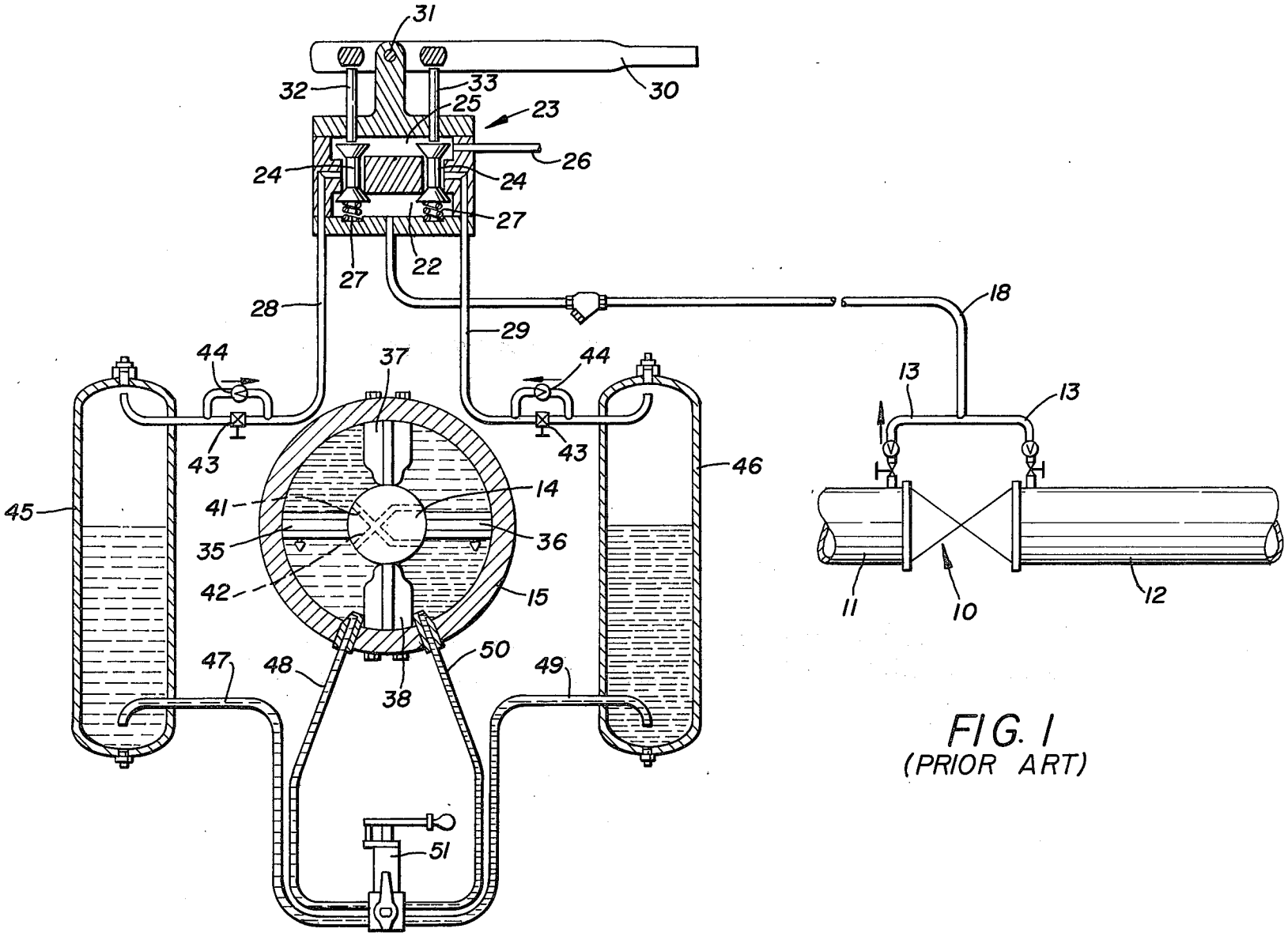
FIG. 1 (PRIOR ART)
FIG. 1 is a schematic view of a prior art hydraulic rotary vane valve operator system utilizing pressurized oil tanks and having cross-over ports through the rotor connecting opposite fluid chambers.

The pressure fluid furnishing the power for operating the rotor 14 is the gas in the pipeline and preferably tap lines 13 from pipe sections 11 and 12 are both connected to a power supply line 18 which supplies gas under pressure to the pressure chamber 22 of a control valve indicated generally at 23. This valve is adapted to connect line 18 to one side or the other of the hydraulic motor and to connect the opposite side to exhaust. In the neutral position shown the valve 23 is entirely shut off from the motor 15.

The control 23 may have double-headed poppet valves 24 between the pressure chamber 22 and the exhaust chamber 25 which is connected to exhaust conduit 26. The valves 24 are biased by springs 27 normally to shut off the pressure chamber from conduits 28 and 29 which connect the valve ports to opposite sides of the hydraulic motor. A handle 30 for actuating the poppet valves 24 is pivoted at 31 on a projection from the housing of control valve 23, and the handle may be manually or automatically operated to actuate the rods 32 and 33 for selectively operating the poppet valves 24 to connect the pressure chamber 22 to one of the conduits 28 or 29 and the other conduit to exhaust 26.

Conduits 28 and 29 are operatively connected through housing 15 to the motor on opposite sides of the vanes of the rotor 14. The rotor has two diametrically opposite vanes 35 and 36 which rotate between stationary shoes 37 and 38. Variable volume chambers are formed between the vanes and the shoes, and cross-over ports 41 and 42 are provided through the rotor 14 for connecting diametrically opposite chambers to apply equal pressure on both vanes 35 and 36 when turning the rotor in either direction.

The conduits 28 and 29 are connected into the top ends of oil tanks 45 and 46 and the bottom ends of the tanks are connected by conduits 47, 48 and 49, 50, respectively, to the motor on opposite sides of one of the shoes, for example, shoe 38. Preferably, each of the conduits 28 and 29 has a throttling valve 43 therein for regulating flow to the motor, and a by-pass line having a check valve 44 therein for permitting free flow from the motor around the throttling valve. The conduits 47, 48 and 49, 50 normally by-pass a hand pump 51 having a selector valve for connecting into the lines for use in manually operating the motor 15 as a stand-by operation.

The oil tanks are normally used to provide oil for passing in a closed circuit to and from the motor in response to the gas pressure conducted from the pipeline, so that flow to and from the motor can be more easily controlled by orifice sizes or throttling valves and floating or overtravel of the piston is substantially eliminated. The oil tanks also allow for expansion and contraction of the oil in the motor due to temperature changes.

Referring to FIGS. 2 – 5, the rotary hydraulic motor has a cylindrical housing 15 with top and bottom closure plates 52 and 53 secured thereto by screw studs 54. The rotor 55 is keyed to the valve stem 56 of a rotary valve (not shown) such as pipeline valve 10 in FIG. 1, and the rotor has diametrically opposite vanes 35 and 36 which rotate between diametrically opposite stationary shoes 37 and 38 secured to housing 15 by screw studs 57. Preferably, the rotor 55 is journaled in bearing bushings 58 and 59 in the top and bottom plates 52 and 53, respectively, and 0-rings 60 in the bushings provide seals around the rotor.

Figure 2:
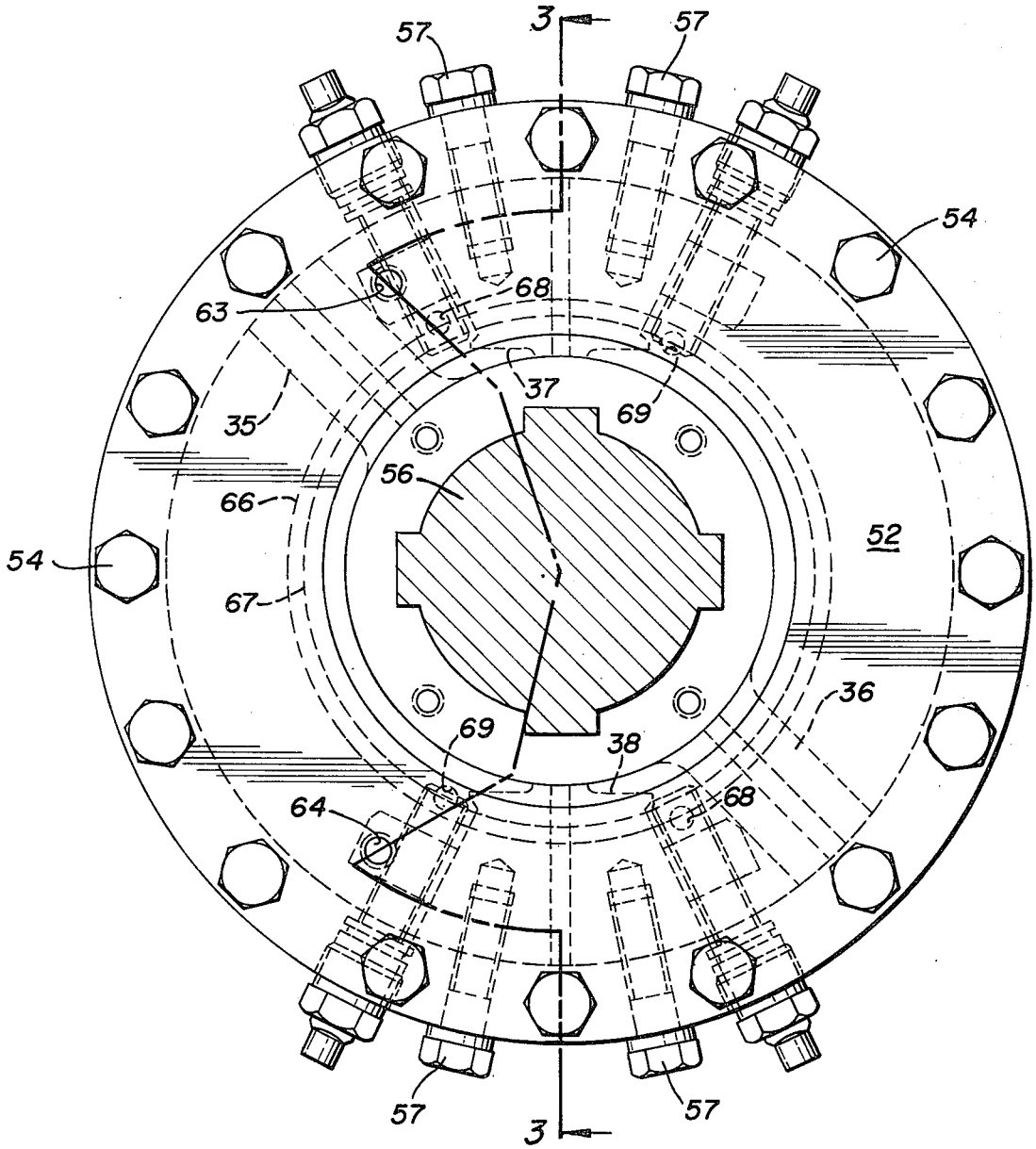
FIG. 2 is a plan elevational view of the improved rotary hydraulic motor operator construction.

Each of the vanes 36 and 36 is provided along its top side and bottom edges with sealing gaskets 61 having sharp corners between the side and top and bottom portions to prevent the escape of pressure fluid from one chamber to another. The top, bottom, inner and outer edges of the shoes are similarly provided with sealing gaskets 62 extending continuously around the shoes and having sharp corners to prevent the escape of pressure fluid from one chamber to another. As shown in FIG. 2, a pressure or exhaust port 63 (that is, the port is alternately connected to pressure and exhaust as flow through the motor is reversed) is provided in the top plate 52 to connect with the varying volume chamber on one side of vane 35 and a pressure or exhaust port 64 is provided in the top plate 52 to connect with the varying volume chamber on the opposite side of the vane 35. Obviously, the two ports 63 and 64 could be positioned on opposite sides of one of the shoes 37 or 38 as in the prior art construction of FIG. 1, if cross-over ports are provided between opposite chambers.

An annular cross-over groove 66 is provided in top plate 52 surrounding the bushing 58 and having its open side abutting the bushing, and a second annular cross-over groove 67 is provided in the plate 52 surrounding the bushing 58 at a level below groove 66 and having its open side abutting the bushing. 0-rings are provided in plate 52 on opposite sides of and between the grooves 66 and 67 to seal off the grooves. The groove 66 is connected by two ports 68 in the plate 52 disposed parallel to the rotor axis to two diametrically opposite variable volume chambers, and the groove 67 is connected by two ports 69 to the two diametrically opposite variable volume chambers on opposite sides of the vanes 35 and 36.

Thus, when pressure is supplied through port 63 to one variable volume chamber on the pressure side of vane 35, the diametrically opposite variable volume chamber on the pressure side of vane 36 will be connected to said first chamber by the ports 68 and connected cross-over groove 66, and the exhaust port 64 will be connected to one variable volume chamber on the exhaust side of vane 35, which is in turn connected to the diametrically opposite variable volume chamber on the exhaust side of the vane 36 by the ports 69 and connected cross-over groove 67.

Figure 3:
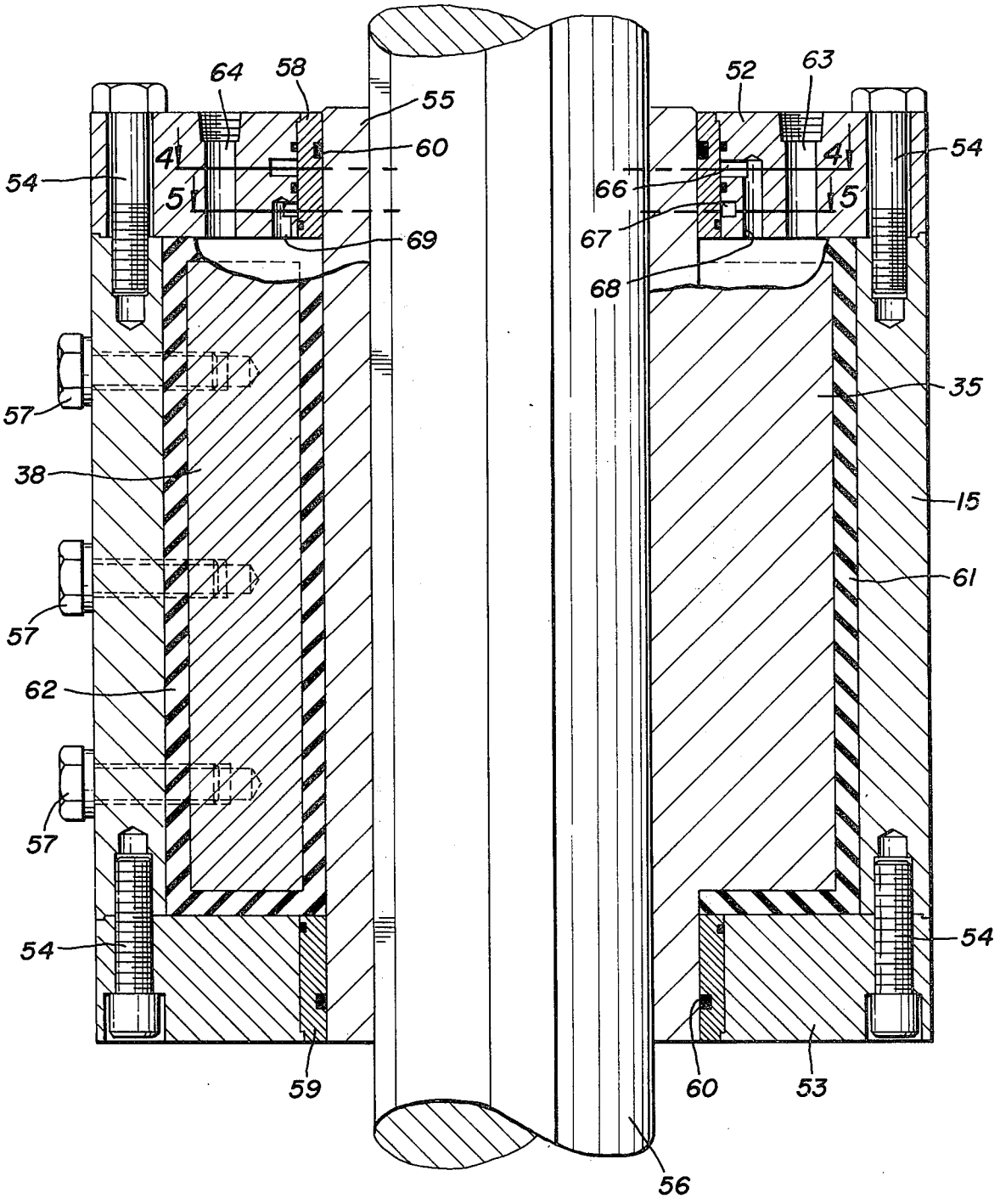
FIG. 3 is a vertical sectional view on line 3—3 of FIG. 2.
Figure 4:
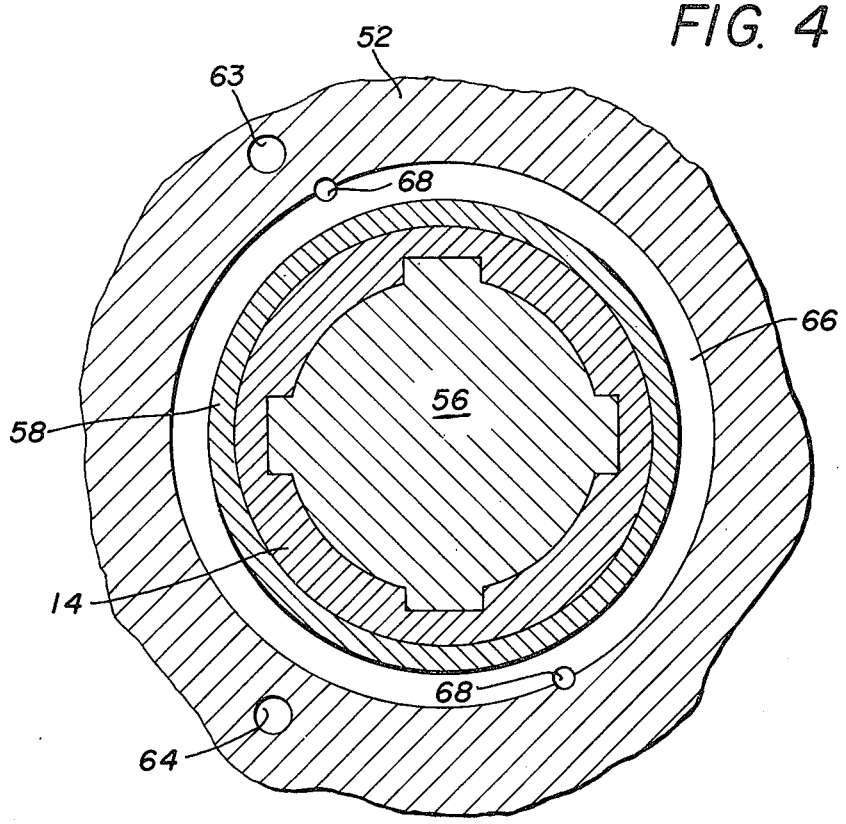
FIG. 4 is a cross-sectional view on line 4—4 of FIG. 3.
Figure 5:
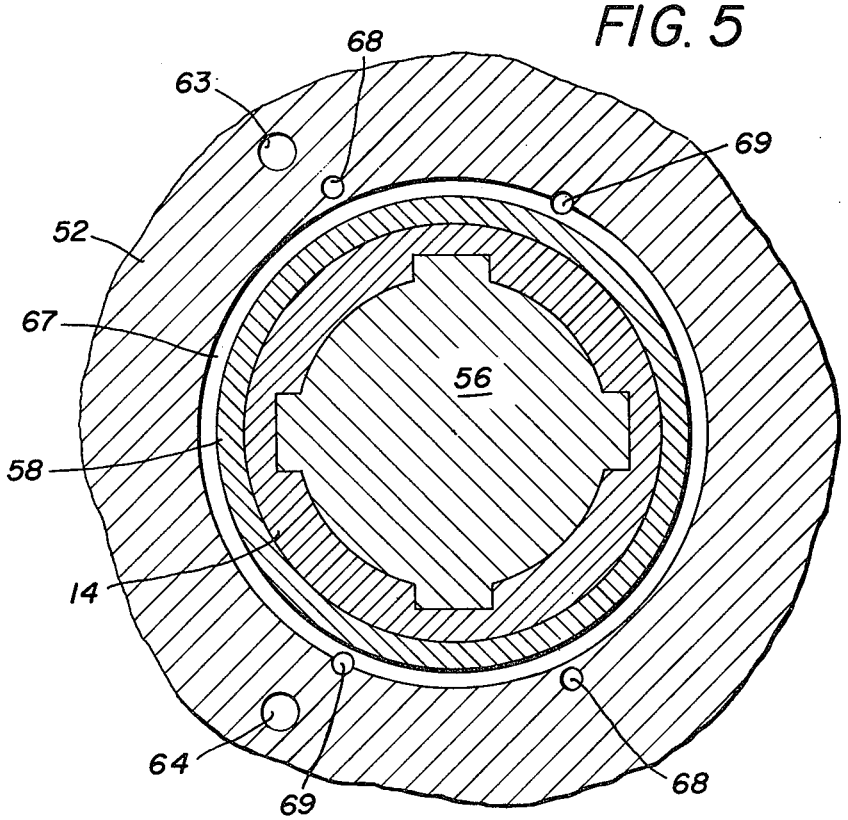
FIG. 5 is a cross-sectional view on line 5—5 of FIG. 3.

It will be seen by reference to FIGS. 2 and 3 that the gas bubbles rising to the tops of the two diametrically opposite chambers connected by cross-over groove 67 will be carried with the exhausting oil through exhaust port 64 to the oil tank on the exhaust side of the system where the bubbles will rise to the top of the oil level and go to exhaust. Gas bubbles entrained in the oil introduced through pressure port 63 and rising to the tops of the other two diametrically opposite chambers will, when flow is reversed, be carried with the exhausting oil through the port 63 to and vented from the other oil tank then on the exhaust side.

Accordingly, the gas bubbles entrained in the pressurized oil are removed from the two exhaust chambers alternately each time flow through the motor is reversed, and are not permitted to accumulate in the hydraulic motor and cause corrosion together with the other disadvantages heretofore discussed.

I claim:

1. In a hydraulic motor having a rotor with diametrically opposite vanes for rotating between stationary shoes providing two pairs of fluid pressure chambers of varying volume on opposite sides of the vanes, conduits for supplying pressure fluid to one pair of said chambers and exhausting it from the other pair, a housing including a top plate enclosing said rotor, said top plate having a bearing bushing journaling said rotor; the improvement comprising two ports alternating as pressure fluid supply and exhaust ports in the top plate connected one to one chamber of each said pair, and cross-over passageways in said top plate connecting the chambers of each pair together, said cross-over passageways being annular grooves encircling said bearing bushing and having one open side abutting said bearing bushing.

2. In a hydraulic motor as defined in claim 1, in which the annular cross-over passageway grooves are disposed at different levels and ports substantially parallel to the rotor axis connect said grooves to opposite chambers.

3. In a hydraulic motor as defined in claim 2, in which 0-rings are provided between the annular cross-over passageway grooves to seal off one groove from the other along the surface of the rotor.

* * * * *